United States Patent [19]

Stobb

[11] Patent Number: 4,983,155

[45] Date of Patent: Jan. 8, 1991

[54] PAPER WEB CUTTER

[75] Inventor: Walter J. Stobb, Pittstown, N.J.

[73] Assignee: Stobb Inc., Clinton, N.J.

[21] Appl. No.: 520,839

[22] Filed: May 7, 1990

Related U.S. Application Data

[63] Continuation of Ser. No. 182,454, Apr. 18, 1988, abandoned.

[51] Int. Cl.[5] ..... B26D 1/56; B65H 37/00

[52] U.S. Cl. ..... 493/369; 493/361; 493/365; 493/367; 493/370; 83/155; 83/326

[58] Field of Search ..... 493/227, 235, 236, 239, 493/357, 358, 361-365, 367, 369, 370; 83/155, 300, 326, 339; 414/412

[56] References Cited

U.S. PATENT DOCUMENTS

| | | | |
|---|---|---|---|
| 2,538,425 | 1/1951 | Nolan | 83/155 |
| 2,797,097 | 6/1957 | Stobb | 271/82 |
| 3,300,365 | 1/1967 | Roos | 83/326 |
| 3,886,832 | 6/1975 | Harris | 83/326 |
| 4,151,699 | 5/1979 | Focke et al. | 493/363 |
| 4,287,801 | 9/1981 | Hanson | 83/326 |
| 4,785,696 | 11/1988 | Martiny | 83/49 |

FOREIGN PATENT DOCUMENTS

| | | | |
|---|---|---|---|
| 546941 | 6/1956 | Belgium | 493/235 |

*Primary Examiner*—Frederick R. Schmidt
*Assistant Examiner*—Jack Lavinder
*Attorney, Agent, or Firm*—Arthur J. Hansmann

[57] ABSTRACT

A paper web cutter for cutting across the width of a moving web of paper in locations along the length of the web, for severing the web in two sections. Two conveyors carry the web therebetween and hold the web against each other. One conveyor carries a cutter which operates to cut either the full web width, or only a part of the web width, and another cutter then cuts the remainder of the web width.

23 Claims, 3 Drawing Sheets

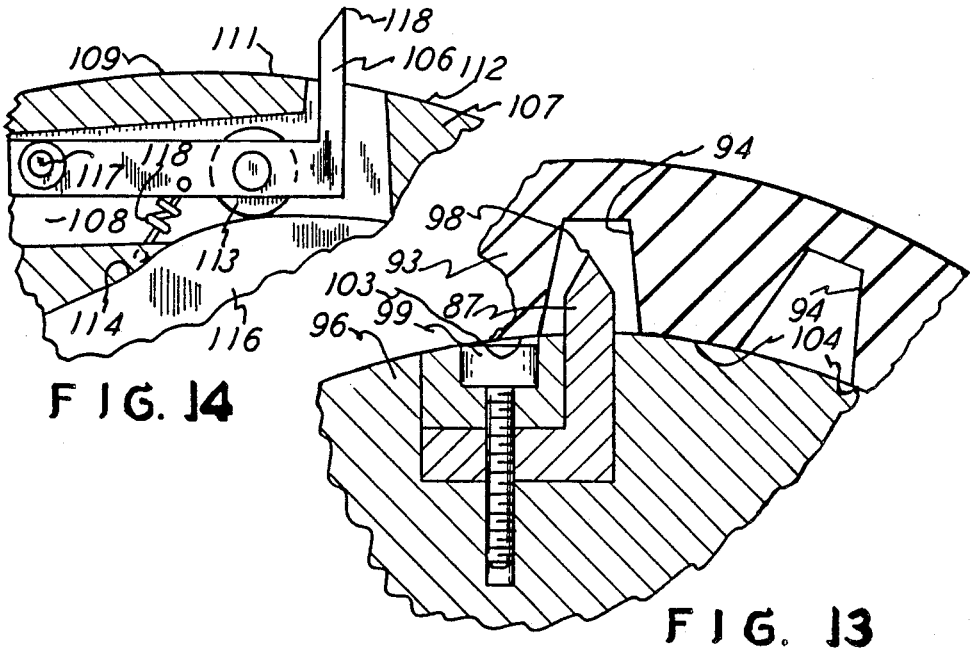
FIG. 14
FIG. 13
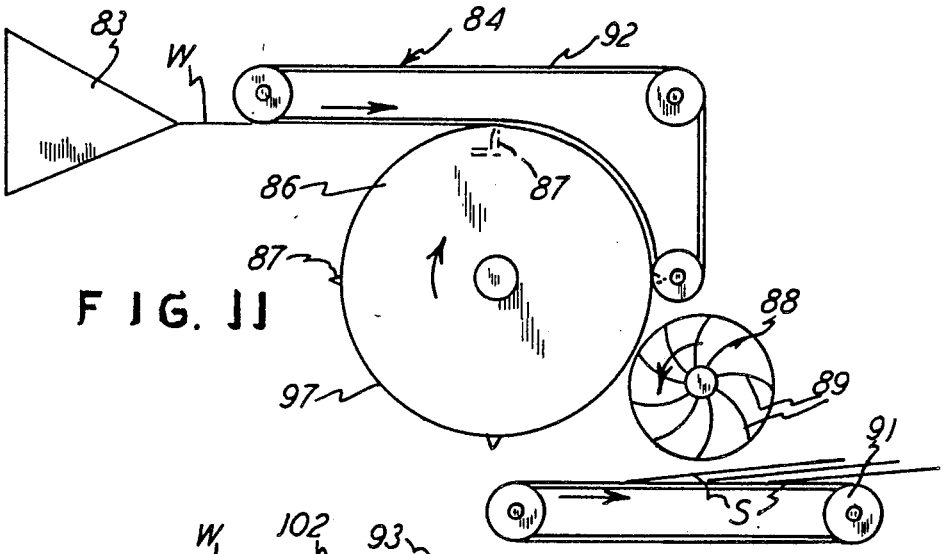
FIG. 11
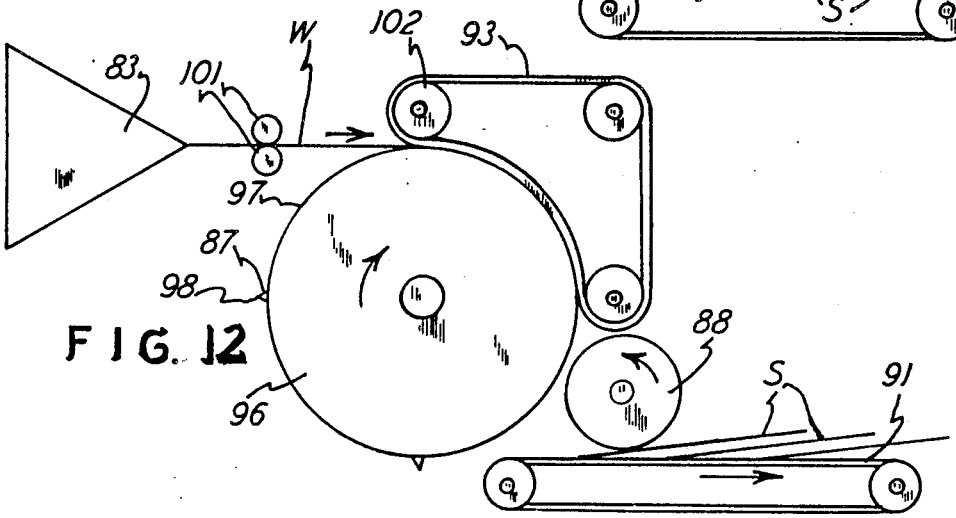
FIG. 12

PAPER WEB CUTTER

This application is a continuation of abandoned application No. 07/182,454, filed Apr. 18, 1988, now abandoned.

This invention relates to a paper web cutter, and, more particularly it relates to a cutter for a continuously moving web of paper which can be cut across its width in desired lengths.

BACKGROUND OF THE INVENTION

The prior art utilizes paper web cutters of a rotary type where two cylinders, in rolling contact, carry the respective cutter elements of a cutter and an anvil or the like. The web passes between the two cylinders, and the cutter then shears the paper across its width. In some instances, the cut paper is gripped by one of the rotating cylinders and the cut section is then conveyed away See U.S. Pat. No. 2,797,097.

In that arrangement of the prior art, the concern is with regard to the provision for, and the synchronization of, the cutter and the anvil. That is, they must be provided for in durable metal material which is generally required to be hardened, and the mating between the cutter and the back-up member on the other cylinder must be with extreme precision. These limitations and requirements also result in a restriction on the permissable speed of moving the web of paper.

The present invention improves upon the prior art cutters in that it combines both the conveying and cutting members in the same elements of the conveyor itself, all such that the web is positively held by the conveyor and is also cut while moving at a high speed. This is achieved because the web is simultaneously held on its opposite faces at the same time that it is cut and conveyed forward along its path of movement, and at no time is the web free of the conveyor until it is deposited on a collecting conveyor or the like.

In accomplishing the objective of improving upon the prior art and avoiding the precise requirements of rotary cutters in the way of synchronizing cutter and anvil, the invention provides for two opposed lengths of conveyor belts which engage respective faces of the web for moving the web and for holding the web while it is being cut during its movement. The shearing cutter itself is carried on a moving member which progresses or moves with the forwarding of the web, and the opposed belts retain tension in the web so that it is accurately and cleanly cut, and the belts also retain the cut web for conveying it to the deposit conveyor or the like.

A further improvement of the present invention is with respect to providing two cutters, or assemblies thereof, at two different stations along the path of the moving web, with one of the cutters cutting across the width of the web in only a portion thereof, such as in a perforated type of cut, and with the other cutter at the downstream station cutting the remainder of the web, so that the complete web is finally cut. Still further the present invention provides for only the first of the aforementioned cutter which performs the socalled perforated type of cut, and the web can then be further engaged in its downstream travel to be pulled at a faster speed than the speed at the time it is cut, and that faster pulling speed will cause the web to completely sever across its width through a tearing action of the remainder of the width which is otherwise uncut.

In the present invention, the web of paper is moved at a high speed and is severed across its width at various lengths along the web, and the cut sections of the web can then be deposited on a take-off conveyor, as desired. In accomplishing these objectives, the need for precision cutting elements is obviated, and the prior art problem of dullness and wear of the cutting elements is also avoided.

BRIEF DESCRIPTION OF THE DRAWINGS

FIGS. 11 through 14 are of still other embodiments.

DETAILED DESCRIPTION OF THE PREFERRED APPARATUS AND METHOD

The following description will be directed at the apparatus, and, as such, the method aspect will also be inherently disclosed. A web of paper W is moving rightwardly, in FIG. 1, under the influence of incoming conveyors 10, and it moves into the control and grip of a conveyor generally designated 11. Of course the web W is in the nature of an endless web of already processed or printed paper, and it is now desired to cut the web across its width and deposit it in cut lengths or sections such as the section S on the takeoff or collector conveyor 12. In all instances of conveyors, they are of course moving in the direction of the arrows adjacent the conveyors.

Figure 1:
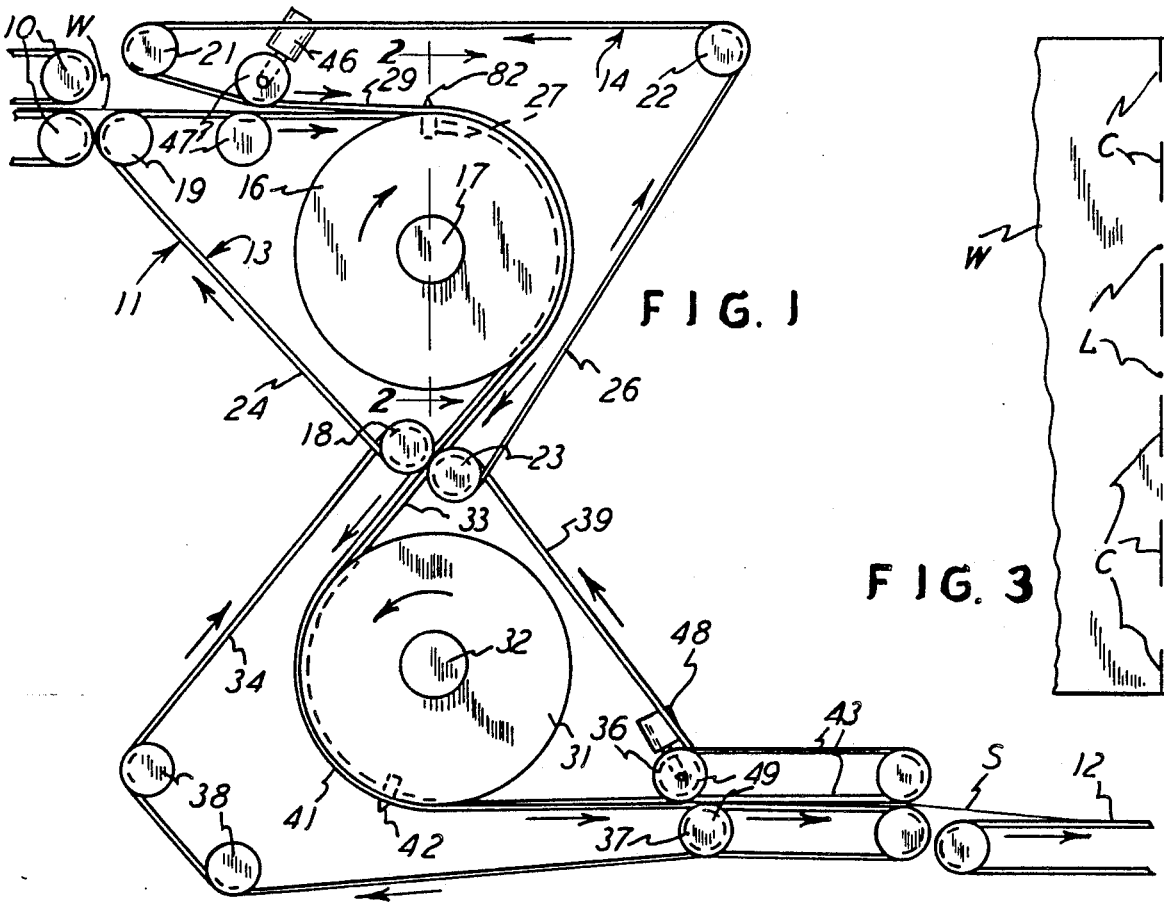
FIG. 1 is a side elevational view of an embodiment of the web cutter of this invention.
Figure 2:
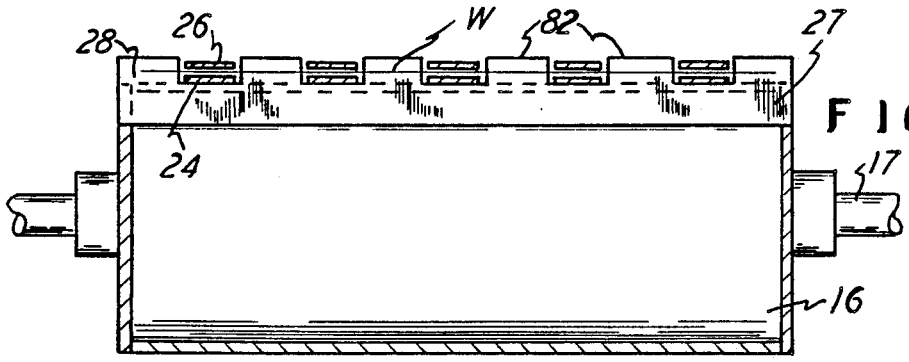
FIG. 2 is a sectional view taken on the line 2—2 of FIG. 1.

The conveyor 11 includes an inner section 13 and an outer section 14, both of which are shown to consist of a plurality of conveyor belts in the side-by-side relationship, such as seen in FIG. 2. The conveyor 13 is trained over a cylinder or drum 16 which is rotatably mounted on a shaft 17 and rotates in the direction of the arrow shown thereon, and it is also trained over pulleys or the like 18 and 19 so that the conveyor 13 is endless and makes repetitious cycles. Also, the conveyor 14 is endless and it is trained over pulleys 21, 22, and 23, and it too is trained over the drum 16 in approximately the right-hand half thereof as seen in FIG. 1. The conveyors 13 and 14 therefore contact the opposite faces of the web W, that is the lower and upper surfaces, respectively, and tightly control and move the web around the drum 16 to the direction therebelow, as indicated.

As mentioned, the conveyors 13 and 14 are composed of conveyor belts 24 and 26, respectively, and the belts are in side-by-side and spaced-apart positions, as seen in FIG. 2, and the web W is therebetween.

A knife or shearing cutter 27 is shown affixed to the drum 16 and extends radially therefrom to project beyond the belts 26 when in the FIG. 1 position, for instance. FIG. 2 also shows that the knife 27 has its cutting edges 28 in spacedapart but aligned positions along one line, and they penetrate or cut the web W when the conveyors 13 and 14 move through their parallel movement portions designated 29. Of course the web W is cut in spaced positions along the cutline designated L, in FIG. 3, and the actual cuts, designated C, are shown spaced-apart along the line L and they were created by the six shown knives or cutters 28. Therefore, the web W is cut in the nature of a perforated type of cut in that it is discontinuous when the web W is moving around the drum 16 and to the position therebelow.

Another cutter assembly is disposed in the lower half of FIG. 1, and it includes a rotatably mounted drum 31 on a support shaft 32, and it also has an inner conveyor 33 and an outer conveyor 34. Again, the conveyors 33 and 34 consist of a plurality of face-to-face or overlying belts, such as the five belts shown in FIG. 2. As such, the conveyors 33 and 34 receive the web W and continue to convey it downwardly and counter-clockwise around the roller 31 and out onto the take-out conveyor 12.

The conveyor 33 includes the usual pulleys, such as another one of the pulleys 23, and a series of aligned pulleys 36. Also, the conveyor 34 includes another one of the pulleys 18 and an aligned series of pulleys 37 and pulleys 38 It will be understood that the upper two conveyors 13 and 14 and their respective belts are offset with respect to the lower two conveyors 33 and 34 and their respective belts, all so that the web can be continously conveyed, without interruption or gap from the upper half to the lower half of FIG. 1 and through the intermediary of the series of pulleys 18 and 23 which support the belts of both the upper and lower sections being described. That is, the lower conveyors 33 and 34 have face-to-face belts designated 39 and 41, respectively, for snugly and tightly gripping the web W therebetween, as indicated by the belts and web in FIG. 2. Further, as shown and as will be understood in this description, the belts between the upper and lower halves of FIG. 1 are offset from each other, axially of the drums 16 and 31, and thus they can pass each other and perform the function of the continuous conveyance of the web W without any gap in the contact and support of the web until it is desposited on the conveyor 12.

With the offset of the belts as mentioned, the belts 39 and 41, being aligned with each other, are disposed in positions of the cuts C across the width of the web, and thus the line L across the width of the web which is uncut is exposed and is available for cutting. To cut that uncut portion, a shearing cutter or knife 42 is affixed to the roller 31 and extends therefrom, and is in the nature and relationship of the cutter 27. Therefore, when the cutter 42 rotates to approximately the 10 or 11 o'clock position, as viewed in FIG. 1, then the cutter 42 will penetrate the web line L in its several uncut portions and perform the cut or shear of the web and thus have the web fully severed across its width at the line L. Of course the cut section would continue to be conveyed by the conveyors 33 and 34 and would move into the control of conveyors 43 which ultimately deposit the cut section S on the conveyor 12.

In these arrangements, a tensioning device 46 is effective on a pair of pulleys or the like 47 to assure a tight grip of the web W, in the upper half of FIG. 1, and also a tensioning device 48 operates on two Pulleys 49 on which the respective belts 39 and 41 are trained, so that the web W will be snugly and tautly held by the conveyors for the shearing action as well as accurate conveyance. The devices 46 and 48 are in the nature cf extenders, such as compression springs or the like which force the rollers 47 and 49 into tight gripping relationship with the web W.

In the aforementioned manner, the web W is cut into sections S, and the cut can be completely across the width of the web along the line L while the web W is moving at a high speed and non-stop. The respective cutters 27 and 42 simply project between the belts in their respective conveyors, and since the web is held taut while being cut, no anvil or other mechanism is required for engaging and controlling the web or the cutting action.

Figure 3:
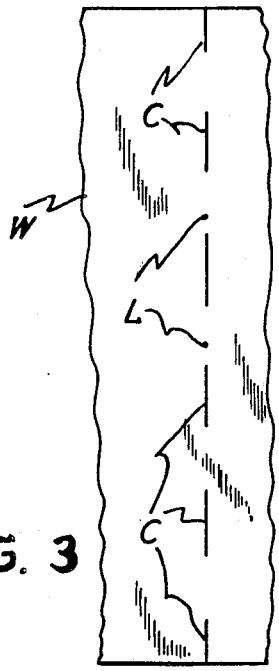
FIG. 3 is a plan view of a web of paper, showing the first cuts thereon

Still further, if only one of the drums 16 and 31 and their respective conveyors was utilized, then the conveyors 43 can be utilized to operate at a speed faster than the speed of the web at the location of contact with the drums, and since the conveyor 43 is engaging the opposite faces of the web W and operating at a faster speed, it can actually pull the remaining uncut portion of the web apart, along that line L and after of course the web has received the spacedapart cuts C, as shown in FIG. 3. In the case of that arrangement, then only one of the cutters 27 and 42 is required.

Figure 4:
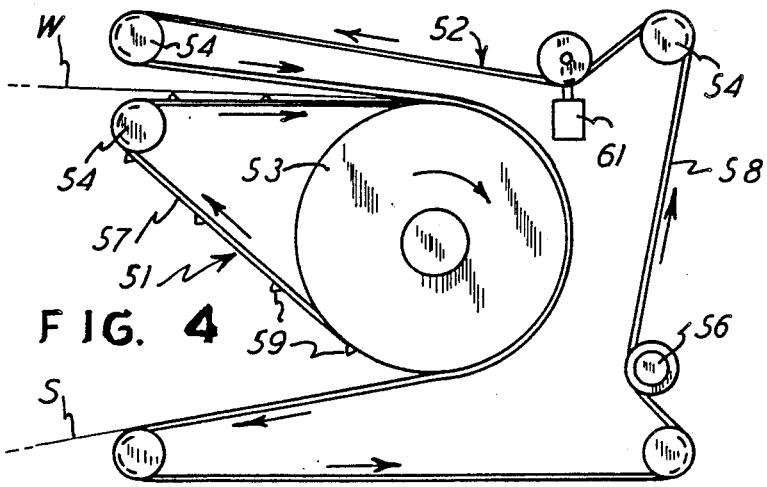
FIGS. 4 and 5 are side elevational views of two other embodiments of this invention.

FIG. 4 shows the single section of the combined conveyor and cutter, and it includes the inner conveyor and outer conveyor, generally designated 51 and 52, respectively, which are trained over a drum 53 and on pulleys 54. A drive motor 56 is shown engaged with the outer conveyor 52 and of course the movement of the two conveyors 51 and 52 would be in precise unison for the conveyance of the web W. Further, the conveyors are shown to have the belts 57 and 58, respectively in that side-by-side relationship mentioned and indicated, all for conveying the web W through the unit and to produce the cut sections S, as indicated. Thus, the inner belts 57 are provided with spaced-apart shear cutters 59 attached to the belts and extending therefrom for penetrating the web W in approximately the 12 o'clock position of FIG. 4. In that arrangement, the sections S would be of the length between consecutive cutters 59 which form the perforated type of cut already shown in FIG. 3. A belt tightener 61 can be employed for assuring the synchronized drive desired.

Figure 5:
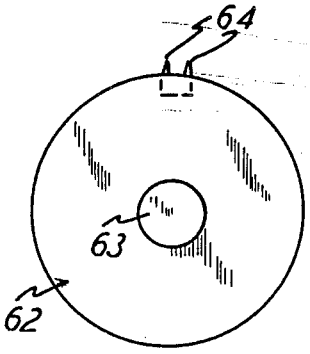

FIG. 5 shows a drum 62 which would be rotatably mounted on a shaft 63 for rotation and use such as the previously described drums, and it is shown to have two shearing cutters 64 extending radially therefrom for cutting the web W in two close lines of cut and thereby form a "chip" type of cut where a section across the width of the web is perforated and utlimately removed, when that type of cut is desired.

Figure 6:
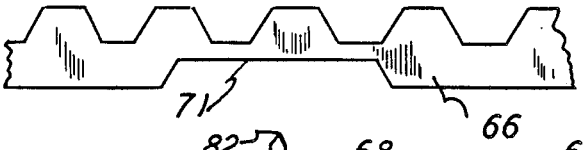
FIGS. 6 and 7 are side elevational views of timing types of conveyor belts showing a cutter of this invention incorporated therein.
Figure 7:
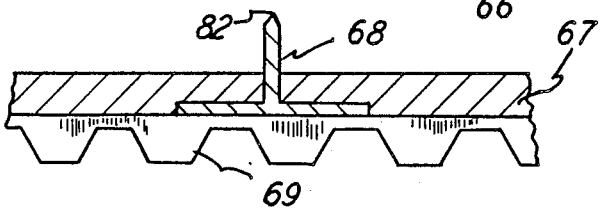

FIGS. 6 and 7 show an enlarged side or sectional views of conveyor belts of the timing belt type. Thus the outer belts would be the belt 66 and the inner belt would be the belt 67 carrying a cutter 68 which could be embedded in the belt 67. The two belts have the usual teeth or cogs 69 for the timing belt feature of moving the belts in precise synchronization relative to each other. Also, the outer belt 66 has a recess 71 which accommodates, by receiving, the knife or cutter 68 when the two belts are in overlying position with only the web W therebetween, as described in connection with FIGS. 1 or 4.

Figure 8:
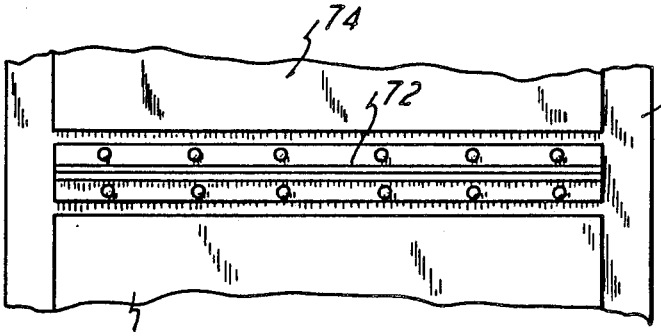
FIGS. 8, 9, and 10 are top, end, and front views, respectively, of conveyor belts with cutter elements of this invention in still another embodiment.
Figure 9:
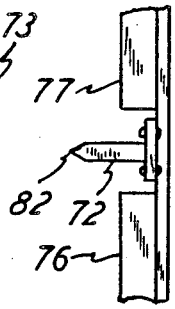
Figure 10:
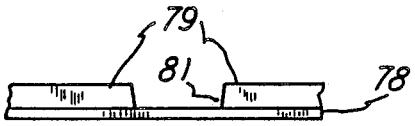

FIGS. 8, 9, and 10 show another arrangement of belts, and here a cutter 72 extends across the width of the belt 73, and it would of course make one continuous cut across the web W when the belt 73 is utilized as one of the inner cutting belts described herein. The belt 73 thus has the cutter 72, of the T-shape shown in FIG. 9, and also that being the shape in FIG. 7, and the cutter 72 is suitably affixed to the base of the flexible belt 73.

Also, the belt 73 has raised sections 74 and 76 flanking the cutter 72, and these sections 74 and 76 are in the nature of cushions so they have good frictional characteristics on their surfaces 77, and they may actually be pliable to indent when the web is thereon and the two opposing belts are being tensioned toward each other for holding the web W therebetween FIG. 10 shows the mating or outer belt 78, and it too has the cushioned faces or surfaces 79 for engaging the web and thus tautly and non-slidably holding the web with the cushions of belt 73. Again, the belt 78 has an opening 81 for receiving the cutter 72 when the two are aligned and are mated in the cutting action described herein.

In all of these instances, there are two matched conveyors, an inner and outer conveyor, and they have portions which move in parallelism while gripping the web W therebetween. At that time the web is sheared by the cutters, which have cutting edges 82 projecting toward the outer conveyor, all for penetrating the web.

In all instances, drums 16, 31, 53, and 62 are a respective part of the inner conveyor, such as conveyors 13 and 51. Also, the cutters 59 and 72 are mounted directly on the inner belts 57 and 73, respectively. In all instances, there are conveyor portions that move parallel to each other and have a cutter thereon for movement toward the other conveyor for shearing the web held between the portions.

FIG. 11 shows another embodiment where the web W is passed over a standard former/folder 83 and moves into the control of a conveyor 84 which extends approximately one-quarter around the circumference of a cylinder 86. Four web cutters 87 are mounted equally spaced around the cylinder 86, and the cylinder rotates in the direction of the arrow shown, and thus the web W is trapped between the cylinder 86 and the conveyor 84 and the four cutters 87 will sever the web W at the location at the top of the cylinder 86.

The severed sections of the web W are then presented to a rotating fan 88 which has the usual shelves 89 for receiving the individual cut sections of the web W and for depositing those sections onto a slow-moving take-off conveyor 91, so that the web sections are placed in a shingled form, as indicated. From there the web sections S move to a conventional sheet stacker.

In that embodiment in FIG. 11, and also in the embodiment in FIG. 12, the web W can be severed across its entire width by the individual cutters 87 in that the conveyor 84 includes the web guiding belt 92, and a similar belt 93 in FIG. 12, which are timing belts, such as shown in FIGS. 13. That is, the timing belt has the usual openings 94 spaced therealong across the width of the belt, and aligned ones of the openings 94 will receive the cutters 87 when these elements are at the top of the cylinder 86 of FIG. 11 and a cylinder 96 of FIG. 12. Thus the web W will be pressed against the respective circumferences 97 of the cylinders 86 and 96 to be snug therewith for severing or penetration by the knife edge 98 of a respective cutter 87.

FIG. 13 further shows that the cutter 87 is mounted on the circumference 97 of a respective roller or cylinder 86 and 96, and a screw 99 extends through the cutter 87 and into the respective cylinder 86 and 96 for securing the cutters 87. The paper web W will of course be held against the respective circumferences 97 by the respective cylindrical circumferences and the inside edge of the timing belts 92 and 93, respectively, and thus the web is held firmly while being sheared and of course during the time that there is continuous movement, according to the arrows shown.

Further, FIG. 12 shows nip rollers 101 which are positioned between the former 83 and the cylinder 96 to advance the web W in the direction of the arrow shown and to the position between the belt 93 and the cylinder circumference 97. Also, the belt 93 is trained on a pulley 102 which is located at the direct top of the cylinder 96 and which then also serves to press the timing belt 93 downwardly and against the cylinder circumference 97 at the instant that the web is being severed by the knife or cutter 87, and thus the web W is firmly held, as mentioned, while it is being severed.

The outer conveyor, which includes the timing belts 92 and 93, as well as the outer belts in the previous embodiments, will press against the respective circumferences 97 of the adjacent cylinders 86 and 96, at surfaces 103 and 104 extending across the circumference 97 on opposite sides of the location of the cutter 87, for instance. As such, the web is held firmly while it is being cut.

FIG. 14 shows there is a cutter 106 which is radially movably mounted on its support cylinder 107 which has an opening 108 for receiving the cutter 106. In the FIG. 14 position, the cutter 106 is extended and would therefore have cut through the web of paper extending over the circumference 109 of the cylinder 107, and this would be at the time while the outer conveyor or timing belt 93 is pressing the web against the cylinder circumference 109 at locations 111 and 112 so that the web is firmly held while the cutter 106 passes through the web for shearing it completely across the web.

FIG. 14 further shows that the radially movable cutter 106 carries a cam follower 113 rotatable thereon, and the follower 113 rides on a cam surface 114 which is the periphery of a cam 116 adjacent the clyinder 107. Of course the movable cutter 106 is shown to be pivotally mounted on a pivot pin 117 affixed to the cylinder 107 for rotatable displacement with the cylinder 107 while permitting inward and outward radial movement relative to the cylinder 107 and in the opening 108 in the cylinder 107.

Therefore, the cutter 106 will extend beyond the circumference 112 in the approximate one o'clock position of the cylinder 107, and that is when the web is being firmly held at the circumferential locations 111 and 112. Also, the cutting edge 118 of the cutter 106 may be a serrated edge for maximum cutting efficiency. There may be a plurality of the cutters 106 spaced around the cylinder 107, as in the arrangement shown in FIG. 11 with cutters 87.

With the cam operated embodiment, the cutter 106 will not move beyond the cylinder circumference 109 until the web W is being firmly held against the circumference 109 and in both locations 111 and 112. That is, the web W contacts the cylinder 107 tangentially, but the cutter 106 will not engage the web until the web is being held at the circumferential locations 111 and 112 at which time the cylinder 107 has rotated to the position where the cam follower 113 activates to extend the cutter 106 into contact with and through the web W and across its entire width to make a complete cut of the web. Of course there would be suitable means for causing the cam follower 113 to remain with the cam 114, that is, radially inwardly relative to the circumference 109 until the severing or cutting action is undertaken, and that could be simply a spring urging the cutter 106 inwardly, such as with the spring 118 anchored between the cylinder 107 and the cutter 106. The cam embodiment could be incorporated in FIGS. 11 and 12. FIG. 14 can be substituted into FIGS. 11 and 12, in respect to the cutters.

What is claimed is:

1. A paper web cutter for cutting across the width of a moving web of paper in locations along its length and transverse to the longitudinal direction of movement of the web of paper, comprising a continuously cycling conveyor having a length thereof arranged to be guided to present two portions opposed to each other and movable in unison and including two parallel lengths extending in repetitious cycles along said length of said conveyor and with each said parallel length having a surface facing the web of paper and extending along said parallel length to have said surfaces in simultaneous contact with the respective opposite face of the web of paper for movably supporting the web of paper therebetween and with said portions also including lengths movable toward and away from each other in the repetitious cycles, one of said portions including a rotatable cylinder for a curved path of conveyor movement, and the other of said portions including a belt trained onto said cylinder in said curved path which presents at least a portion of said parallel lengths, and a paper cutter mounted on one of said portions and extending therefrom toward the other of said portions and terminating in a cutting edge extending parallel to the plane of the web of paper for cutting the web of paper at a location within said length of said surfaces and when said portions have moved toward each other into parallelism and said surfaces are simultaneously pressing on the opposite faces of the web of paper.

2. The paper web cutter as claimed in claim 1, wherein said cutting edge is discontinuous such that it cuts less than the full width of the web of paper on a line across said width.

3. The paper web cutter as claimed in claim 2, including a second conveyor in paper flow communication with said cycling conveyor for receiving the cut web of paper therefrom and for gripping said web, and drive means for driving said second conveyor at a speed faster than the speed of said cycling conveyor to thereby pull on said web and tear said web across its width at the location of the cut thereacross.

4. The paper web cutter as claimed in claim 2, including an additional cycling conveyor in paper web flow communication with the first said cycling conveyor for receiving the cut web therefrom, and a paper cutter included in said additional cycling conveyor for cutting the width of the web of paper left uncut on said line by the first said paper cutter.

5. The paper web cutter as claimed in claim 4, wherein said paper cutters are offset from the respective positions of each other and relative to the width of said web of paper, such that said paper cutters cut only respective mutually exclusive lengths along said line.

6. The paper web cutter as claimed in claim 4, wherein both said conveyors have plurality of said conveyor portions and of said paper cutters spaced apart therealong for repeated cutting of said web of paper into lengths of paper, in accordance with the spacing of said cutters on said conveyors.

7. The paper web cutter as claimed in claim 1, including having a plurality of said conveyor portions and of said paper cutters spaced along said cycling conveyor for repeated cutting of said web of paper into lengths of paper, in accordance with the spacing of said cutters on said cycling conveyor.

8. The paper web cutter as claimed in claim 1, wherein said cycling conveyor portions include face-to-face belts in overlying relationship with each other for conveyance of said web of paper between said belts.

9. The paper web cutter as claimed in claim 8, including an additional cycling conveyor in paper web flow communication with the first said cycling conveyor and having portions and a paper cutter and belts and a rotatable cylinder all according to the respective said portions, paper cutter, belts, and rotatable cylinder of the first said conveyor except that the respective said cutters are offset relative to each other and with respect to the width of said web of paper, for respective cutting across the width.

10. A paper web cutter for cutting across the width of a moving web of paper in locations along its length and transverse to the longitudinal direction of movement of the web of paper, comprising two opposed means with each of said means having a surface in simultaneous respective pressing contact with an opposite face of the web of paper and extending along the length of the web of paper for movably supporting the web of paper along its length through respective pressing contact with the opposite faces of the web of paper, one of said means including a rotatably mounted cylinder and the other of said means including a belt trained onto an arcuate portion of said cylinder and with said cylinder and said belt pressing the web of paper therebetween along said arcuate portion, and paper cutting means on only said one of said two opposed means and having an elongated cutting edge extending parallel to the width of the web of paper and having a length to extend across the width of the web and being movable transverse to and through the plane of the web of paper, said other of said two opposed means being completely spaced from said cutting means by presenting a space for receiving said cutting means while the latter moves toward and along with said other of said two opposed means and contacts the web within the length of said surfaces for shearing across the width of the web of paper while the web of paper is movably supported simultaneously between said surfaces on both sides of the shearing along the length of the web.

11. The paper web cutter as claimed in claim 10, wherein said paper cutting means is arranged to cut only a minor fraction along a line across the width of said web of paper, and a second paper cutting means located downstream from the first-mentioned paper cutting means and being arranged to cut along said line and across the uncut remainder of the width of the web of paper, to fully sever said web.

12. The paper web cutter as claimed in claim 10, including two additional opposed means in web paper flow communication with the first-mentioned said two opposed means for movably supporting the web of paper, paper cutting means on one of said two additional opposed means for cutting across the width of the web of paper while the web of paper is moving, all said opposed means including conveyor belts and with said cutting means being on said belts, and with said belts of said two additional opposed means and said cutting means thereon being offset relative to the width of said web of paper and from said belts and said cutting means of the first-mentioned said two opposed means.

13. The paper web cutter as claimed in claim 10, wherein said surfaces are frictional engagement means.

included on said two opposed means for simultaneous engagement of the opposite faces of said web of paper while movably supporting said web of paper and while said web of paper is being cut.

14. The paper web cutter as claimed in claim 10, wherein said paper cutting means is a cutter bar which is of a length to extend continuously and completely across the width of the web of paper for severing the web of paper in movement transverse to the plane of the web of paper, and with said other of said two opposed means being a timing belt having a slot thereacross for defining said space for receiving said cutting means when said cutting means extends through said web for shearing said web of paper.

15. The paper web cutter as claimed in claim 10, including a former/folder member disposed in the path of said web upstream from said two opposed means for folding said web prior to said web being received by said two opposed means, and including a delivery fan in sheet flow communication with said two opposing means for receiving the cut sections of said web, and a delivery conveyor in sheet movement communication with said fan for receiving said cut sections from said fan and arranging them in shingled fashion.

16. The paper web cutter as claimed in claim 10, wherein said cutting means includes paper cutters spaced-apart along said one of said two opposed means for repeated cutting of said web of paper into lengths of paper, in accordance with the spacing of said cutters.

17. The paper web cutter as claimed in claim 10, wherein said paper cutting means is movable on said one of said two opposed means, to move toward and away form said web of paper, and means for moving said cutter toward and away to effect cutting action.

18. A method for repeated cutting of a web of paper across the width of the web and while the paper is being conveyed along a path in direction of the length of the web, comprising the steps of supporting a web of paper across the width thereon and on opposite faces of said web for and along an arcuate path, conveying said web of paper along its said supported length and past a station which is located within the extent of said arcuate path, and moving a paper shearing cutter with an elongated cutting edge both along said arcuate path and through said web at said station and solely in the direction transverse to the plane of said web at intervals for cutting across the width of said web and forming cut lengths of said web.

19. The method for repeated cutting of a web of paper, as claimed in claim 18, wherein said web is cut across the width thereof in only a minor fraction of a line across said width, and including the step of moving a second paper shearing cutter along with and through said web on said line at the uncut portion thereof for cutting said web along said line.

20. The method for repeated cutting of a web of paper, as claimed in claim 18, wherein said web is supported across its entire width at two spaced-apart locations along the length of said web, and cutting across the entire width of said web at said station while said web is being supported across its width.

21. The method for repeated cutting of a web of paper, as claimed in claim 18, including advancing said web over a former folder prior to supporting said web at said station, and moving the cut lengths of said web to a paper controlling fan, and moving said cut lengths from said fan and onto a slow moving delivery conveyor to position said cut lengths in shingled arrangement.

22. The method for repeated cutting of a web of paper, as claimed in claim 18, wherein the moving of said shearing cutter is effected through the influence of a cam operative in response to the conveyance of said web of paper.

23. The method for repeated cutting of a web of paper, as claimed in claim 18, wherein said web is supported across its entire width at two spaced-apart locations along the length of said web, and cutting across the entire width of said web at said web station by simultaneously cutting both longitudinal edges of said while said web is being supported across its width.

* * * * *